US009201386B2

(12) United States Patent
Mori et al.

(10) Patent No.: US 9,201,386 B2
(45) Date of Patent: Dec. 1, 2015

(54) IMAGE FORMING APPARATUS

(71) Applicant: FUJI XEROX CO., LTD., Tokyo (JP)

(72) Inventors: Masahiro Mori, Kanagawa (JP); Misa Hishida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/268,452

(22) Filed: May 2, 2014

(65) Prior Publication Data

US 2015/0110516 A1 Apr. 23, 2015

(30) Foreign Application Priority Data

Oct. 18, 2013 (JP) ..... 2013-217711

(51) Int. Cl.
*G03G 21/20* (2006.01)
*G03G 21/16* (2006.01)

(52) U.S. Cl.
CPC ..... *G03G 21/1633* (2013.01)

(58) Field of Classification Search
CPC ..... G03G 21/1633; G03G 15/6529; G03G 2215/00016; G03G 2215/00371; G03G 2215/00383; G03G 2215/00822; G03G 2221/1654; G03G 21/1647; G03G 2221/1687; G03G 2221/169; G03G 15/2035; G03G 21/1853
See application file for complete search history.

(56) References Cited

U.S. PATENT DOCUMENTS

2006/0029417 A1 2/2006 Kawamata et al.
2009/0290905 A1 * 11/2009 Mizuno et al. ..... 399/111

FOREIGN PATENT DOCUMENTS

JP A-2006-47569 2/2006

* cited by examiner

*Primary Examiner* — Roy Y Yi
(74) *Attorney, Agent, or Firm* — Oliff PLC

(57) ABSTRACT

An image forming apparatus includes an apparatus body including an image forming unit that forms an image; an opening/closing member that is openable or closeable with respect to a portion of an external surface of the apparatus body; and an absorption member disposed on the opening/closing member at a side facing the image forming unit, the absorption member absorbing sound while facing a portion of the image forming unit in a state where the opening/closing member is closed with respect to the apparatus body.

18 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2013-217711 filed Oct. 18, 2013.

BACKGROUND

Technical Field

The present invention relates to image forming apparatuses.

SUMMARY

According to an aspect of the invention, an image forming apparatus includes an apparatus body including an image forming unit that forms an image; an opening/closing member that is openable or closeable with respect to a portion of an external surface of the apparatus body; and an absorption member disposed on the opening/closing member at a side facing the image forming unit, the absorption member absorbing sound while facing a portion of the image forming unit in a state where the opening/closing member is closed with respect to the apparatus body.

BRIEF DESCRIPTION OF THE DRAWINGS

Exemplary embodiments of the present invention will be described in detail based on the following figures, wherein.

DETAILED DESCRIPTION

First Exemplary Embodiment

Referring now to FIGS. 1 to 5, an image forming apparatus 10 according to a first exemplary embodiment of the present invention will be described. In these drawings, the arrow V indicates a vertical direction and a direction in which the height of the apparatus extends, the arrow H indicates a horizontal direction and a direction in which the width of the apparatus extends, and the arrow D indicates a horizontal direction and a direction in which the depth of the apparatus extends.

Entire Structure

Figure 5:
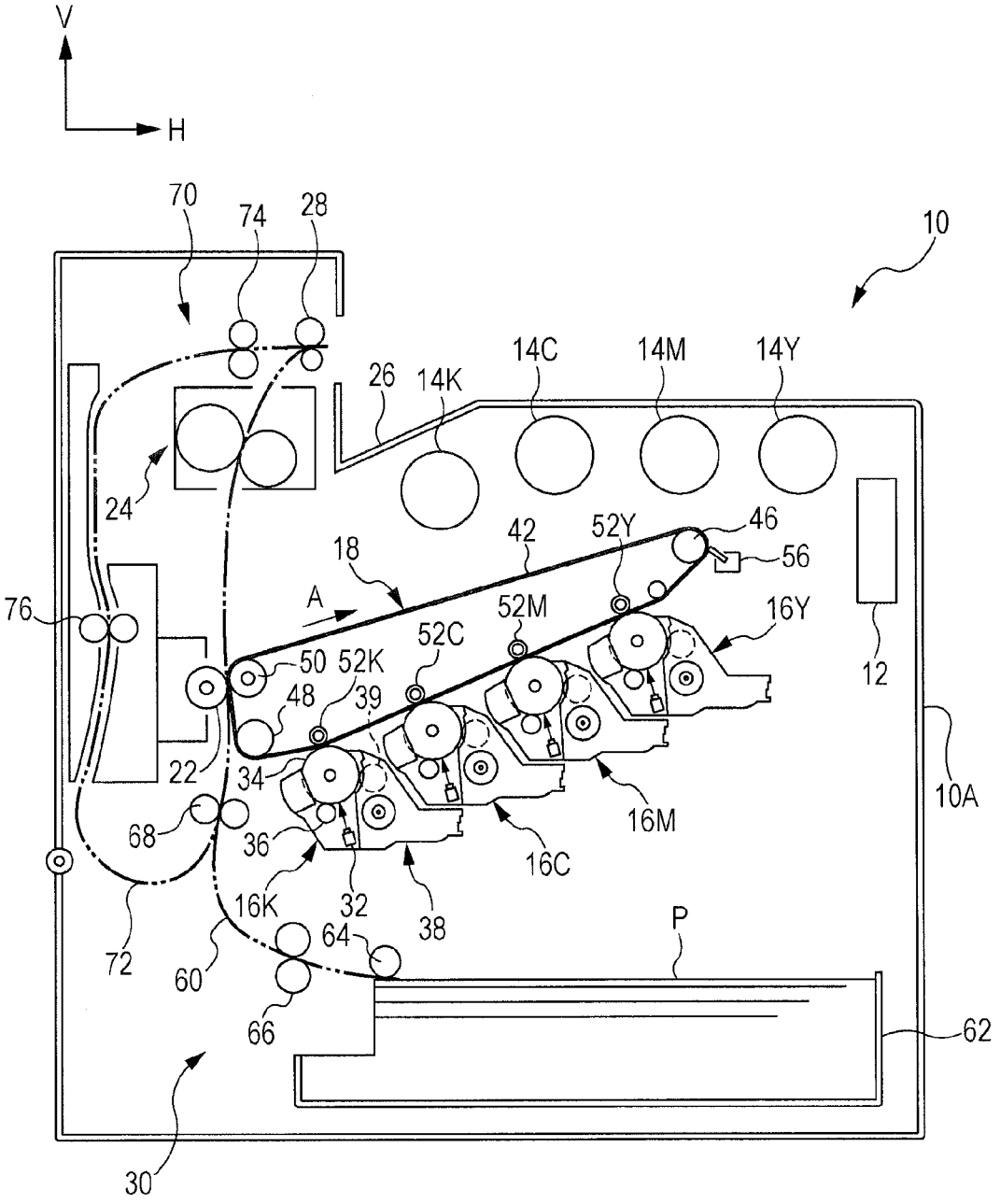
FIG. 5 is a schematic view of the configuration of the image forming apparatus according to the first exemplary embodiment of the present invention.

As illustrated in FIG. 5, the image forming apparatus 10 includes an image processor 12, which performs image processing on input image data, inside an apparatus body 10A of the image forming apparatus 10.

The image processor 12 processes input image data into tone data of four colors, that is, yellow (Y), magenta (M), cyan (C), and black (K).

Image forming units 16Y, 16M, 16C, and 16K, which are examples of four removable members for yellow (Y), magenta (M), cyan (C), and black (K), are disposed in a middle portion of the apparatus body 10A at intervals in a direction extending obliquely with respect to the horizontal direction. The image forming units 16Y, 16M, 16C, and 16K are attachable to and removable from the apparatus body 10A from the front side of the apparatus body 10A. The image forming units 16Y, 16M, 16C, and 16K form toner images of corresponding colors. In the case where components corresponding to yellow (Y), magenta (M), cyan (C), and black (K) do not need to be distinguished from one another, the characters Y, M, C, and K may not be added to the reference numerals.

A first transfer unit 18 is disposed vertically above the image forming units 16 for different colors. Toner images formed by the image forming units 16 for different colors are transferred in a superposing manner to the first transfer unit 18. A second transfer roller 22 is disposed to the side (left, in FIG. 5) of the first transfer unit 18. The second transfer roller 22 transfers the toner images that have been transferred to the first transfer unit 18 in a superposing manner to a sheet medium P, serving as a recording medium, transported along a transport path 60 by a supply-transport unit 30, which will be described below.

A fixing device 24, serving as an example of a fixing member, is disposed downstream from the second transfer roller 22 in the direction in which the sheet medium P is transported (hereinafter this direction is simply referred to as a "sheet transportation direction"). The fixing device 24 fixes the toner images that have been transferred to the sheet medium P to the sheet medium P with heat and pressure. Ejection rollers 28 are disposed downstream from the fixing device 24 in the sheet transportation direction. The ejection rollers 28 eject the sheet medium P to which the toner images have been fixed to an outlet portion 26 at an upper portion of the apparatus body 10A of the image forming apparatus 10.

A supply-transport unit 30 is disposed vertically below and to the side of the image forming units 16 for different colors to supply and transport sheet media P.

Four toner cartridges 14 (14K to 14Y) corresponding to the different colors are arranged side by side in the direction of the width of the apparatus 10 vertically above the first transfer unit 18. The toner cartridges 14 are attachable to and removable from the apparatus body 10A from the front side of the apparatus body 10A and serve as examples of replenishment members that are replenished with toner that is to be fed to the development devices 38. Each toner cartridge 14 has a cylindrical shape extending in the direction of the depth of the apparatus 10 and is connected to a development device 38 of the corresponding color using a replenishment pipe, not illustrated.

Image Forming Unit

Firstly, the image forming units 16 will be described.

All the image forming units 16 for different colors have the same structure, as illustrated in FIG. 5. Each image forming unit 16 includes a cylindrical image carrier 34 that rotates and a charging device 36 that electrically charges the surface of the image carrier 34.

Each image forming unit 16 also includes a LED head 32, which serves as an example of an exposure device that exposes the surface of the charged image carrier 34 with exposure light, a development device 38, which develops an electrostatic latent image formed by image exposure of the LED head 32 with developer (negatively charged toner in this exemplary embodiment) into a visible toner image, and a cleaning blade, which cleans the surface of the image carrier 34 and is not illustrated.

The development device 38 includes a development roller 39 that is disposed so as to face the image carrier 34. The development device 38 develops the electrostatic latent image formed on the image carrier 34 using the development roller 39 with developer into a visible toner image.

The charging device 36, the LED head 32, the development roller 39, and the cleaning blade are arranged in this order from the upstream side to the downstream side in the direction of rotation of the image carrier 34 while facing the surface of the image carrier 34.

Transfer Unit (First Transfer Unit and Second Transfer Roller)

Now, the first transfer unit 18 and the second transfer roller 22 will be described.

As illustrated in FIG. 5, the first transfer unit 18 is disposed vertically above the image forming units 16 for different colors. The first transfer unit 18 includes an endless intermediate transfer belt 42, a driving roller 46 around which the intermediate transfer belt 42 is wrapped, a tension roller 48 around which the intermediate transfer belt 42 is wrapped, a backup roller 50 disposed vertically above the tension roller 48, and first transfer rollers 52. The driving roller 46 drives the intermediate transfer belt 42 to rotate in the direction of arrow A. The tension roller 46 applies tension to the intermediate transfer belt 42. The backup roller 50 serves as an example of an electrode that is driven to rotate by the intermediate transfer belt 42. The first transfer rollers 52 are disposed opposite the image carriers 34 for the corresponding colors with the intermediate transfer belt 42 interposed therebetween.

Thus, the toner images for yellow (Y), magenta (M), cyan (C), and black (K) sequentially formed on the image carriers 34 of the image forming units 16 for the corresponding colors are transferred to the intermediate transfer belt 42 in a superposing manner by the first transfer rollers 52 for the corresponding colors.

In addition, a cleaning blade 56 is disposed opposite the driving roller 46 with the intermediate transfer belt 42 interposed therebetween. The cleaning blade 56 cleans the surface of the intermediate transfer belt 42 by coming into contact with the surface of the intermediate transfer belt 42.

In addition, a second transfer roller 22 is disposed opposite the backup roller 50 with the intermediate transfer belt 42 interposed therebetween. The second transfer roller 22 transfers the toner images that have been transferred to the intermediate transfer belt 42 to a transported sheet medium P. The second transfer roller 22 is grounded. The backup roller 50 serves as an electrode having an opposite polarity to the second transfer roller 22 and a second transfer voltage is applied to the backup roller 50.

Supply-Transport Unit

Subsequently, the supply-transport unit 30 that supplies and transports sheet media P will be described.

As illustrated in FIG. 5, the supply-transport unit 30 includes a paper-feed member 62, in which multiple sheet media P are stacked, in the apparatus body 10A at a portion vertically below the image forming units 16.

The supply-transport unit 30 also includes a pickup roller 64, separation rollers 66, and registration rollers 68. The pickup roller 64 feeds sheet media P stacked in the paper-feed member 62 to the transport path 60. The separation rollers 66 separate sheet media P fed by the pickup roller 64 one from another. The registration rollers 68 regulate the timing at which the sheet medium P is transported. These rollers are disposed in this order from the upstream side to the downstream side in the sheet transportation direction.

This structure allows sheet media P fed from the paper-feed member 62 to be transported by the rotating registration rollers 68 at predetermined timing to a portion (second transfer position) at which the intermediate transfer belt 42 and the second transfer roller 22 are in contact with each other.

The supply-transport unit 30 also includes a double-side-printing transportation device 70, which is used to form a toner image on a second surface of a sheet medium P that has had a toner image fixed by the fixing device 44 on a first surface without causing the ejection rollers 28 to directly eject the sheet medium P to the outlet portion 26.

This double-side-printing transportation device 70 includes a double-side-printing transportation path 72, transportation rollers 74, and transportation rollers 76. Along the double-side-printing transportation path 72, a sheet medium P is transported from the ejection rollers 28 to the registration rollers 68 so as to be reversed. The transportation rollers 74 and the transportation rollers 76 transport the sheet medium P along the double-side-printing transportation path 72.

Others

The apparatus 10 also includes a retraction mechanism (not illustrated) that moves the first transfer rollers 52 for different colors upward to separate the intermediate transfer belt 42 from the image carriers 34 for different colors when the image forming units 16 are attached to and removed from the apparatus body 10A.

Figure 1:
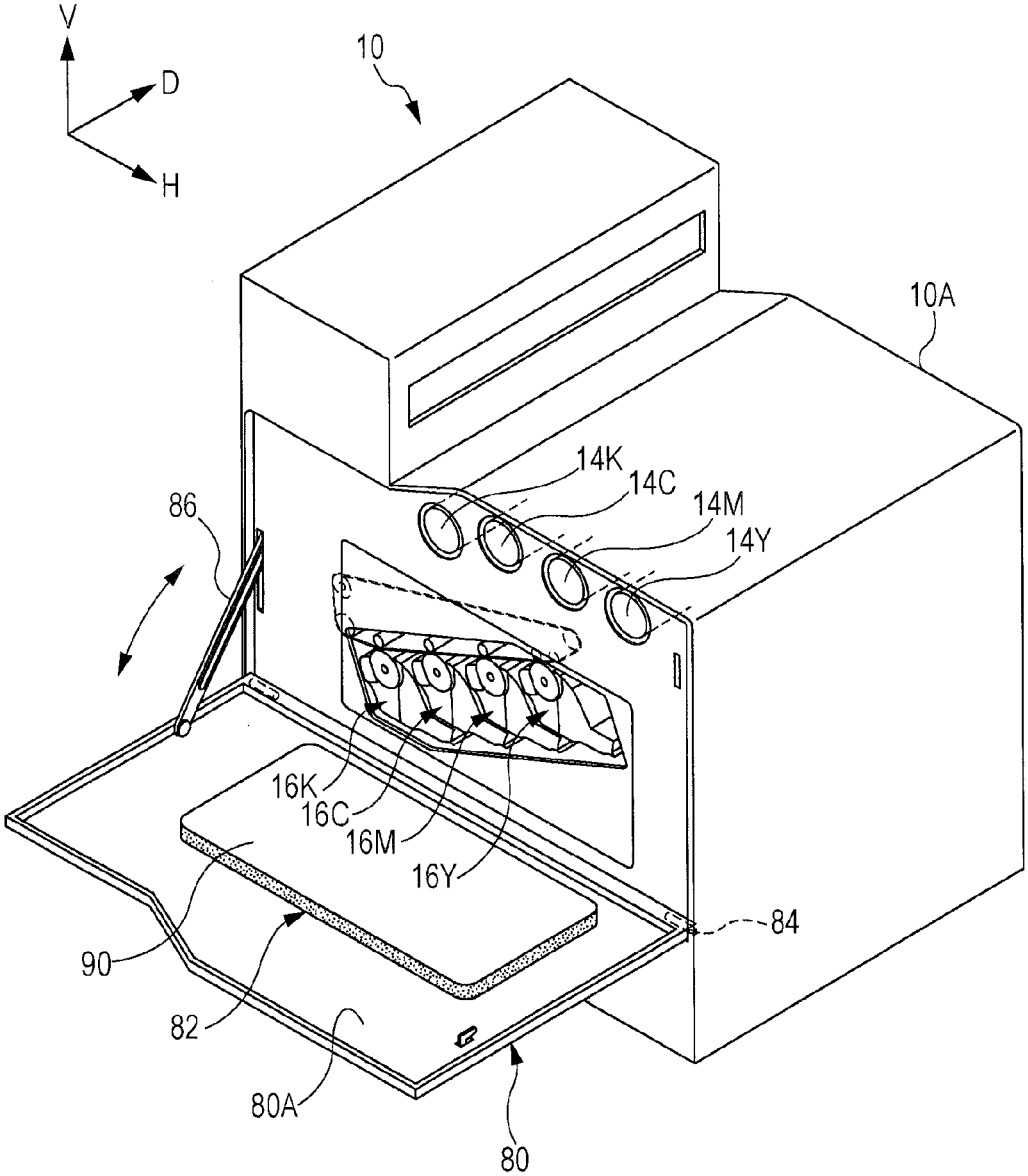
FIG. 1 is a perspective view of an image forming apparatus according to a first exemplary embodiment of the present invention.
Figure 2:
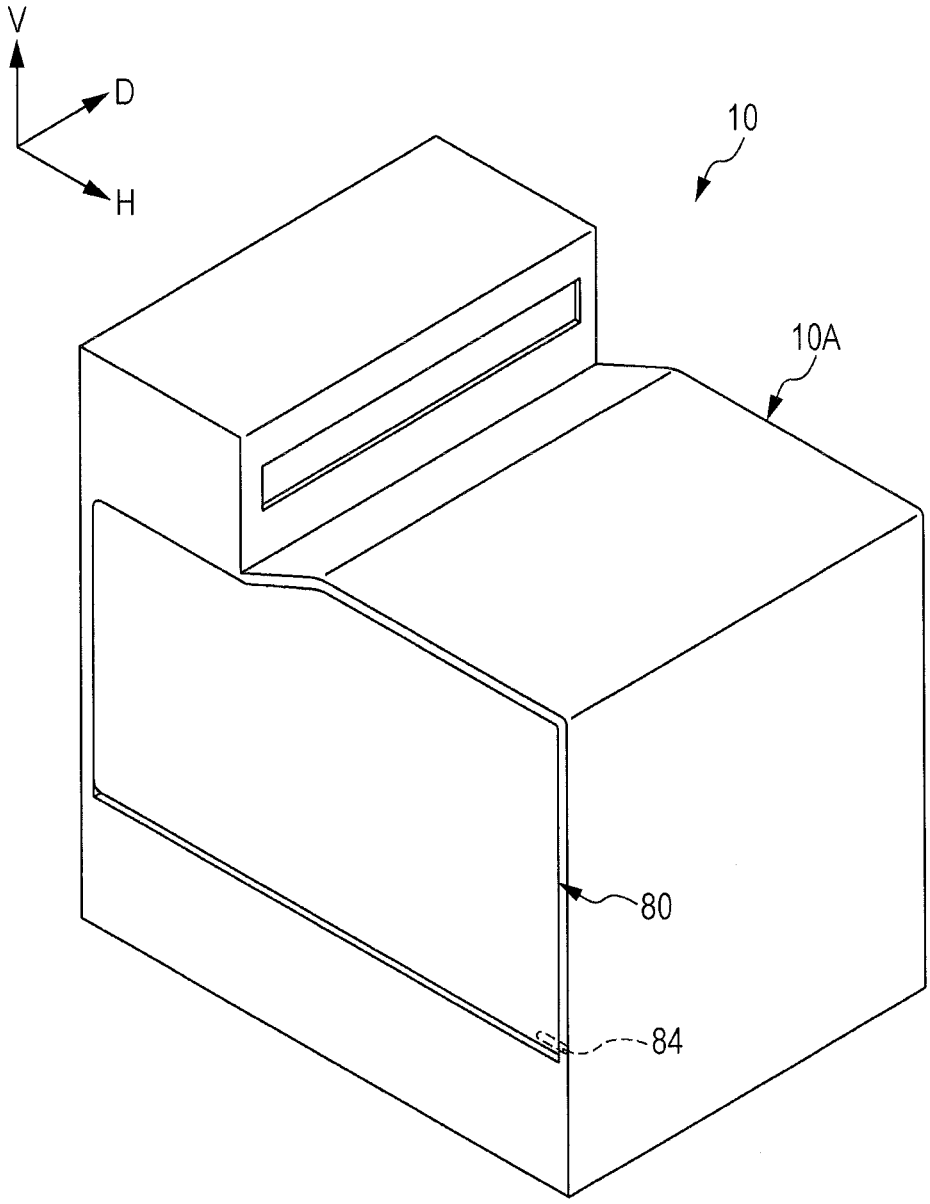
FIG. 2 is a perspective view of the image forming apparatus according to the first exemplary embodiment of the present invention.

As illustrated in FIGS. 1 and 2, the apparatus 10 also includes a cover 80, which is an example of an opening/closing member. When the toner cartridges 14 and the image forming units 16 are attached to and removed from the apparatus body 10A, the cover 80 is switched between a position in which the cover 80 is closed with respect to the apparatus body 10A and a position in which the cover 80 is opened with respect to a portion of the external surface of the apparatus body 10A so as to expose the image forming units 16. A sound absorption member 82 is attached to the cover 80. The sound absorption member 82 is an example of an absorption member that absorbs sound caused by image formation, for example, a driving sound of the image carriers 34 or the development rollers 39. The sound absorption member 82 also absorbs a charging sound (discharging sound) that is produced when each charging device 36, to which an alternating current is input, electrically charges the surface of the corresponding image carrier 34. The cover 80, the sound absorption member 82, and other related components are described in detail below.

Effects of Entire Structure

With this structure, images are formed on sheet media P in the following manner.

Firstly, the image processor 12 sequentially outputs tone data for different colors to the LED heads 32 for the corresponding colors. Then, the surfaces of the image carriers 34 charged by the corresponding charging devices 36 are irradiated with exposure light emitted from the LED heads 32 in accordance with the tone data. Thus, electrostatic latent images are formed on the surfaces of the image carriers 34. The electrostatic latent images formed on the image carriers 34 are developed by the development devices 38 for the corresponding colors into visible toner images of yellow (Y), magenta (M), cyan (C), and black (K).

Then, the toner images of yellow (Y), magenta (M), cyan (C), and black (K) formed on the image carriers 34 by the first transfer rollers 52 of the first transfer units 18 are transferred in a superposing manner onto the rotating intermediate transfer belt 42.

The toner images of the different colors transferred in the superposing manner onto the rotating intermediate transfer belt 42 are second transferred by the second transfer roller 22 at a second transfer position to a sheet medium P that has been transported by the pickup roller 64, the separation rollers 66, and the registration rollers 68 along the transport path 60 from the paper-feed member 62 to the second transfer position.

The sheet medium P to which the toner images have been transferred is further transported to the fixing device 44. Then, the toner images are fixed to the sheet medium P by the fixing device 44. The sheet medium P to which the toner images have been fixed is ejected to the outlet portion 26 by the ejection rollers 28.

When, on the other hand, images are formed on both sides of a sheet medium P, the sheet medium P that has had a toner image fixed to one surface (top surface) of the sheet medium P by the fixing device 44 is not directly ejected to the outlet portion 26 by the ejection roller 28. The direction in which the sheet medium P is transported is switched by reversely rotating the ejection roller 28. Thus, the sheet medium P is transported by the transportation rollers 74 and 76 along the double-side-printing transportation path 72.

The sheet medium P transported along the double-side-printing transportation path 72 is reversed and then transported back to the registration rollers 68. In this time, after a toner image is transferred and fixed to another surface (back surface) of the sheet medium P, the sheet medium P is ejected to the outlet portion 26 by the ejection rollers 28.

Structure of Related Portions

Subsequently, components including the cover 80 and the sound absorption member 82 are described.

Cover

The cover 80 is white (has a brightness of 70% or higher, measured in accordance with JIS 8148). A spectrophotometric brightness meter (PF-10R) from Nippon Denshoku Industries Co., Ltd. is used as a brightness meter. As illustrated in FIGS. 1 and 2, the cover 80 is opened with respect to the apparatus body 10A by being rotated around shaft members 84 disposed at lower portions of the cover 80 until a back surface 80A of the cover 80, that has been facing the charging devices 36, faces upward.

Specifically, the shaft members 84 extend in the direction of the width of the apparatus 10, which is the direction of the rotation axis of the shaft members 84. The image forming apparatus 10 includes a stopper 86 that stops the cover 80 when the back surface 80A of the cover 80 that has been rotating around the shaft members 84 faces upward. Consequently, the cover 80 is opened with respect to the apparatus body 10A in the state where the back surface 80A of the cover 80 faces upward.

Since the cover 80 is opened or closed with respect to the apparatus body 10A, gaps (or so-called plays) having a certain size are generated between the cover and the apparatus body 10A. Thus, the driving sound of components such as the image carriers 34 or the development rollers 39 or the charging sound that occurs when the charging devices 36 electrically charge the surfaces of the image carriers 34 leaks through the gap beyond the cover 80.

As illustrated in FIG. 1, in the state where the cover 80 is opened with respect to the apparatus body 10A, front portions of the toner cartridges 14 and the image forming units 16 in the direction of the depth of the apparatus 10 are exposed. Thus, the toner cartridges 14 and the image forming units 16 are attachable to and removable from the apparatus body 10A from the front side of the apparatus body 10A.

Figure 3:
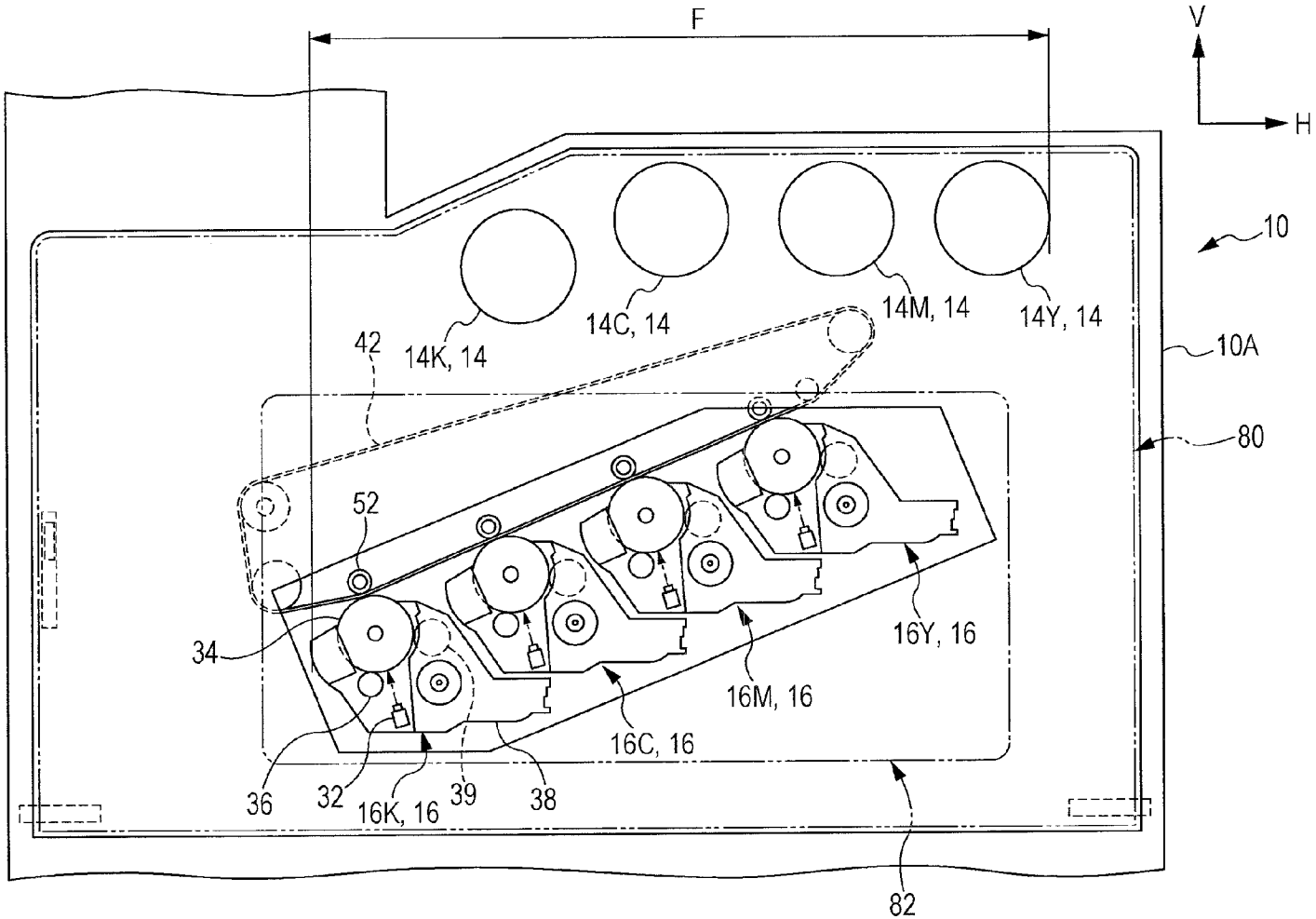
FIG. 3 is a front view of image forming units, toner cartridges, and other components included in the image forming apparatus according to the first exemplary embodiment of the present invention.

On the other hand, as illustrated in FIG. 3, in the state where the cover 80 is closed with respect to the apparatus body 10A, the toner cartridges 14 and the image forming units 16 are covered with the cover 80 when viewed from the front of the apparatus body 10A. Here, the front (front side) of the apparatus body 10A is the side on which users perform various operations on the image forming apparatus 10.

Sound Absorption Member

The sound absorption member 82 is formed of a plate of a porous material (for example, a polyurethane foam). As illustrated in FIG. 1, the sound absorption member 82 is attached to the back surface 80A of the cover 80 with a double-sided adhesive tape, an adhesive, or the like. As illustrated in FIG. 3, the sound absorption member 82 is disposed so as to cover the image forming units 16 when viewed from the front of the apparatus body 10A in the state where the cover 80 is closed with respect to the apparatus body 10A.

In other words, in the state where the cover 80 is closed with respect to the apparatus body 10A, the sound absorption member 82 covers a portion of the image forming units 16 when viewed from the front of the apparatus body 10A. In the state where the cover 80 is closed with respect to the apparatus body 10A, the sound absorption member 82 covers at least a portion of the charging devices 36 when viewed from the front of the apparatus body 10A. The sound absorption member 82 is disposed so as to cover at least a portion of the range (the range F in FIG. 3) within which the image forming units 16 or the toner cartridges 14 are positioned in the direction of the width of the apparatus body 10A. Since the sound absorption member 82 is positioned within the range F of FIG. 3 and the image forming units 16 and the toner cartridges 14 are attached to and removed from the apparatus body 10A from the front side of the apparatus body 10A, the sound absorption member 82 is positioned in at least a portion of a region onto which an attachment/removal trajectory of the image forming units 16 or the toner cartridges 14 is projected vertically downward (in the −V direction).

The sound absorption member 82 has such a thickness as to be deformable due to compression in the state where the cover 80 is closed with respect to the apparatus body 10A.

In this structure, the sound absorption member 82 absorbs a portion of the driving sound of components including the image carriers 34 and the development rollers 39 or a portion of the charging sound caused when the charging devices 36 electrically charge the surfaces of the image carriers 34.

Resin Sheet

Figure 4A:
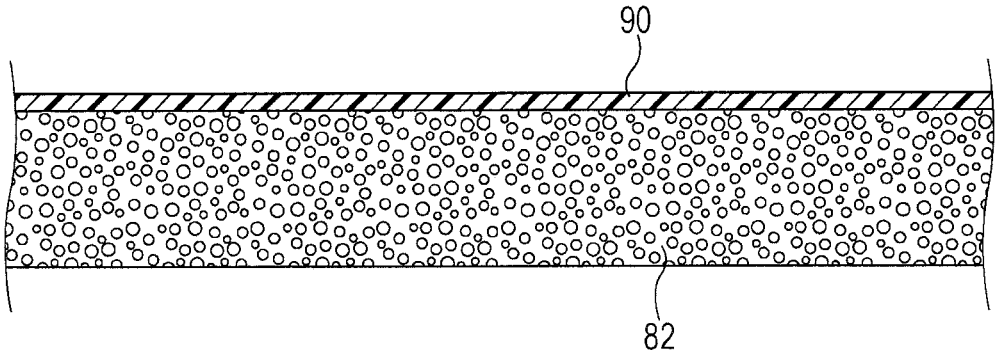
FIG. 4A is a cross-sectional view of a sound absorption member included in the image forming apparatus according to the first exemplary embodiment of the present invention and FIG. 4B is an enlarged cross-sectional view of the sound absorption member.

The sound absorption member 82 has a smooth surface at a side facing the charging devices 36. One way to smooth the surface of the sound absorption member 82 at a side facing the charging devices 36 is, as illustrated in FIG. 4A, to attach a resin sheet 90 (for example, a PET sheet) to the sound absorption member 82, as an example of a flat plate member.

This resin sheet 90 has a color of white (has a brightness of 70% or higher, measured in accordance with JIS 8148), which is similar to the color tone of the cover 80. For example, the color difference ΔE between the color tone of the cover 80 and the color tone of the resin sheet 90 is 20 or lower.

Figure 4B:
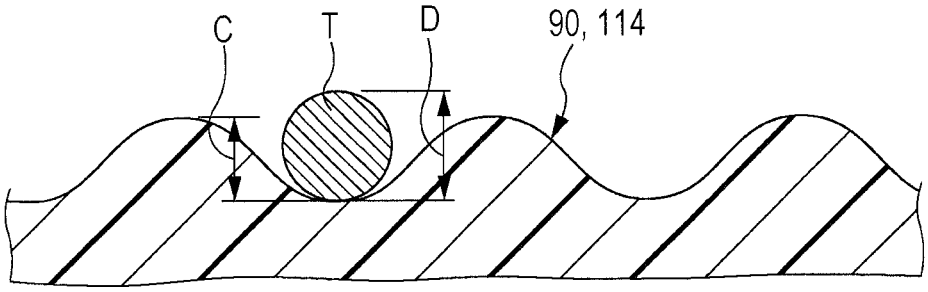

Since the surface of the resin sheet 90 is smooth, the surface of the resin sheet 90 is easily cleanable when toner T is attached to the surface. One way to clean the surface is to wipe the toner T that has adhered to the surface of the resin sheet 90 off the surface of the resin sheet 90 with a dry cloth or the like. For example, as illustrated in FIG. 4B, the difference in height (dimension C in FIG. 4B) between a protrusion and a recess of the resin sheet 90 around toner T is smaller than the volume mean diameter of particles (the volume mean diameter, the dimension D in FIG. 4B) of the toner T used in the image forming apparatus 10. Here, since the resin sheet 90 is a PET sheet, the resin sheet 90 is capable of being wiped with a damp cloth when the surface is excessively dirty.

Here, the attachment of the resin sheet 90 to the sound absorption member 82 reduces the sound absorption performance of the sound absorption member 82 compared to the case of a sound absorption member made only of a porous material. In this exemplary embodiment, however, the resin sheet 90 is attached to the surface of the sound absorption member 82 in order to improve the cleanability of the sound absorption member 82.

In this structure, when the image forming units 16 or the toner cartridges 14 are attached to or removed from the apparatus body 10A from the front side of the apparatus body 10A in the state where the cover 80 is opened with respect to the apparatus body 10A, the toner T that has adhered to the image forming units 16 or the toner cartridges 14 may fall off. Since the resin sheet 90 is attached to the sound absorption member 82, the toner T that has fallen off adheres to the surface of the resin sheet 90 and is thus prevented from clogging the sound absorption member 82. Since the resin sheet 90 has a smooth surface, the toner T that has adhered to the surface of the resin sheet 90 is wiped with a dry cloth or the like.

As described above, the sound absorption member 82 is disposed so as to cover the image forming units 16 for different colors when viewed from the front of the apparatus body 10A in the state where the cover 80 is closed with respect to the apparatus body 10A. Thus, the sound absorption member 82 absorbs a portion of the driving sound of the components such as image carriers 34 and the development rollers 39 or a portion of the charging sound produced when the charging devices 36 electrically charge the surfaces of the image carriers 34.

Since the sound absorption member 82 absorbs sound, the leakage of the sound produced by the charging devices 36 to the front side of the apparatus body 10A is minimized.

In some cases, when the image forming units 16 or the toner cartridges 14 are attached to or removed from the apparatus body 10A from the front side of the apparatus body 10A while the cover 80 is opened with respect to the apparatus body 10A, toner T that has fallen off the image forming units 16 or the toner cartridges 14 may fall onto the cover 80. However, since the resin sheet 90 is attached to the sound absorption member 82, the toner T that has fallen off adheres to the surface of the resin sheet 90 and is prevented from clogging the sound absorption member 82. Thus, the sound absorption performance of the sound absorption member 92 is regulated.

The surface of the resin sheet 90 is smooth. Thus, in the case where toner T adheres to the surface of the resin sheet 90, the toner T is wiped from the surface of the resin sheet 90 with a dry cloth or the like. In this manner, the toner T that has fallen onto and adhered to the surface of the resin sheet 90 is capable of being easily wiped off the resin sheet 90.

Moreover, the cover 80 and the resin sheet 90 have similar color tones. The resin sheet 90 is thus unobtrusive in the state where the cover 80 is opened with respect to the apparatus body 10A, whereby the outward appearance of the cover 80 improves. In the case where the cover 80 and the resin sheet 90 have different color tones, users may mistake the sound absorption member 92 for, for example, a packing material and may remove the sound absorption member 92. The color tone of the resin sheet 90 is designed to be white, whereby users are able to easily see whether or not the surface of the resin sheet 90 is dirty. Thus, this color tone facilitates users to see, after the toner T of yellow (Y), magenta (M), cyan (C), or black (K) that had adhered to the surface of the resin sheet 90 has been wiped off the resin sheet 90, that the toner T has been wiped from the resin sheet 90.

Second Exemplary Embodiment

Figure 6:
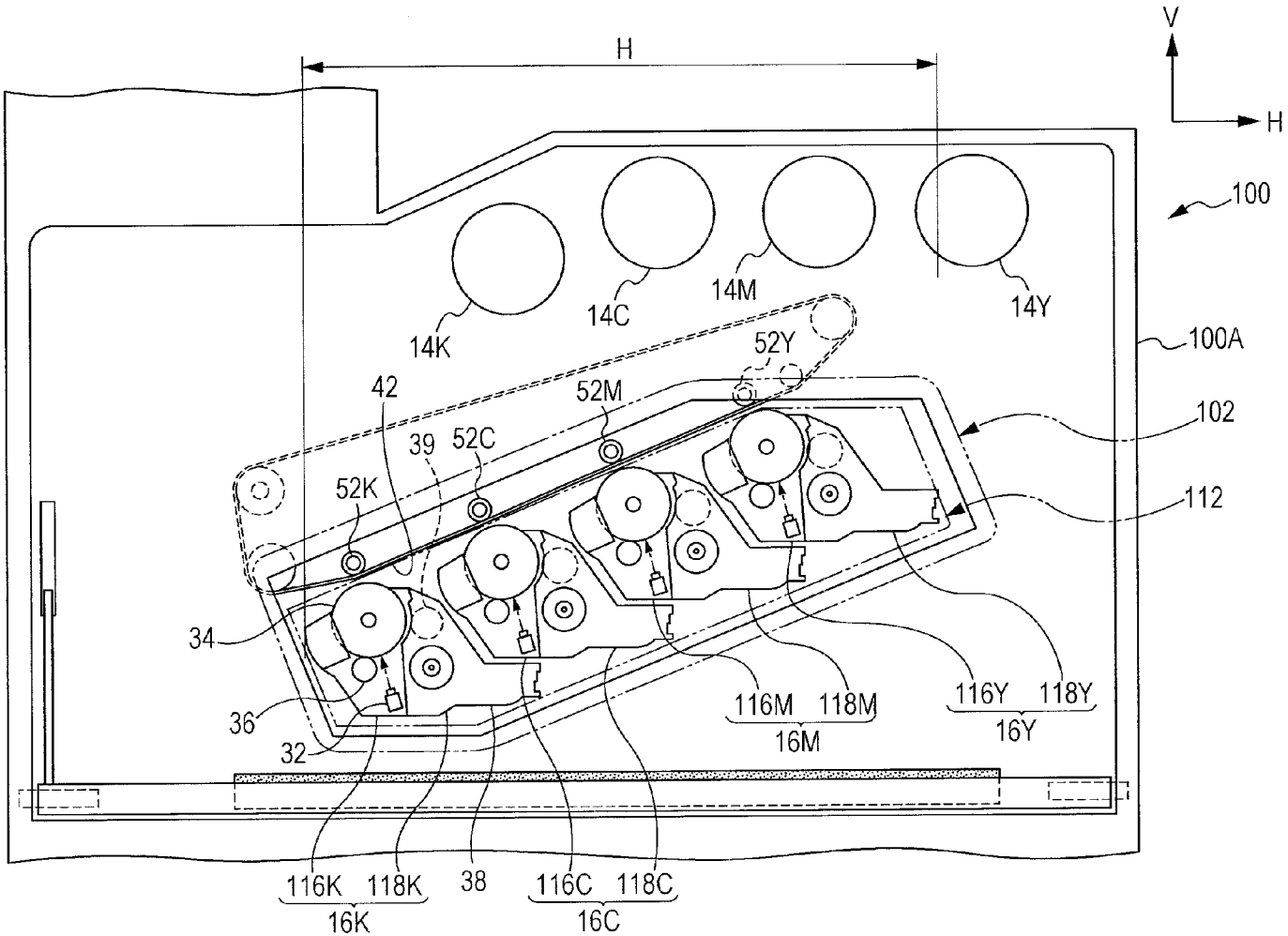
FIG. 6 is a front view of image forming units, toner cartridges, and other components included in an image forming apparatus according to a second exemplary embodiment of the present invention.
Figure 7:
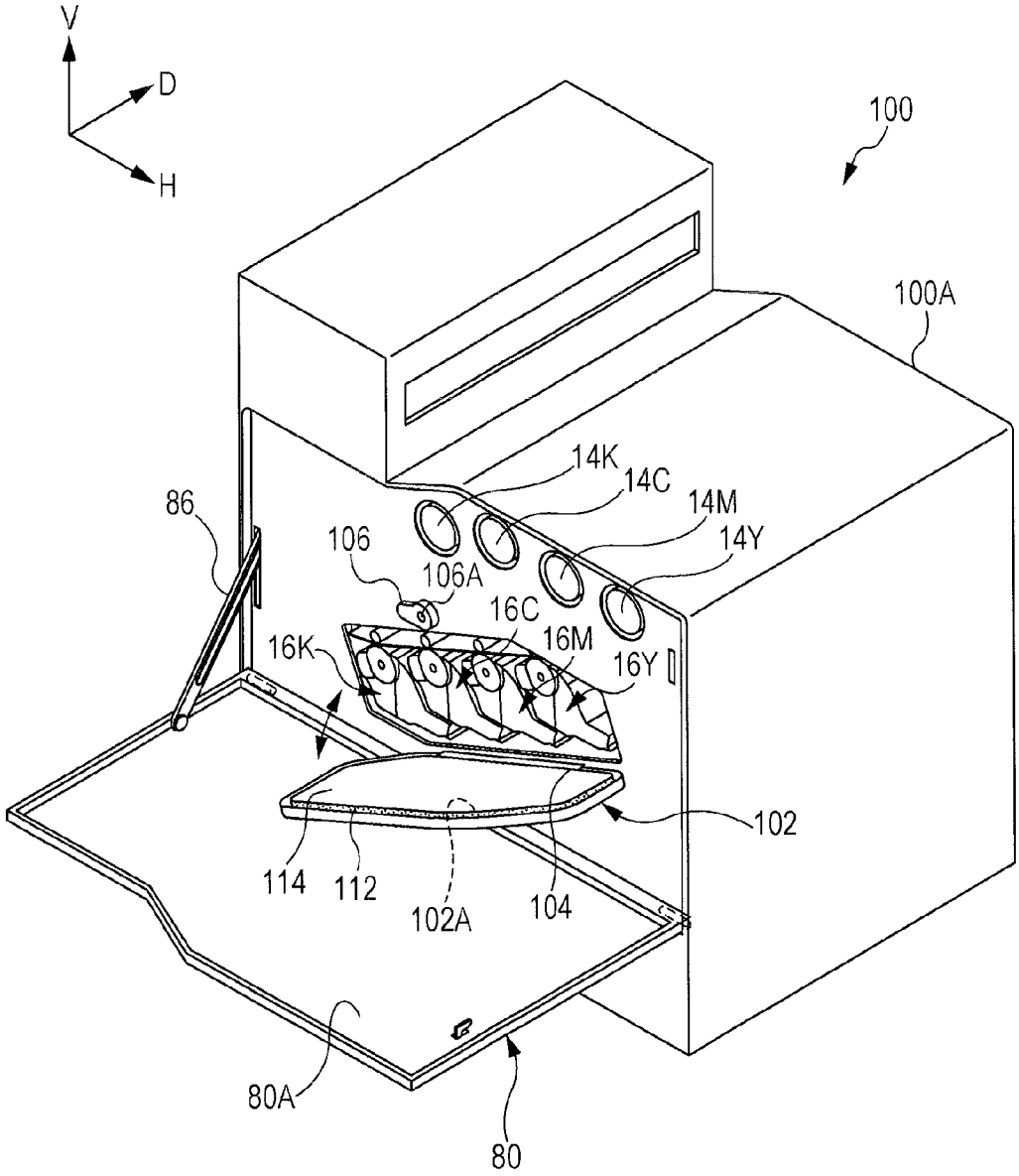
FIG. 7 is a perspective view of the image forming apparatus according to the second exemplary embodiment of the present invention.
Figure 8:
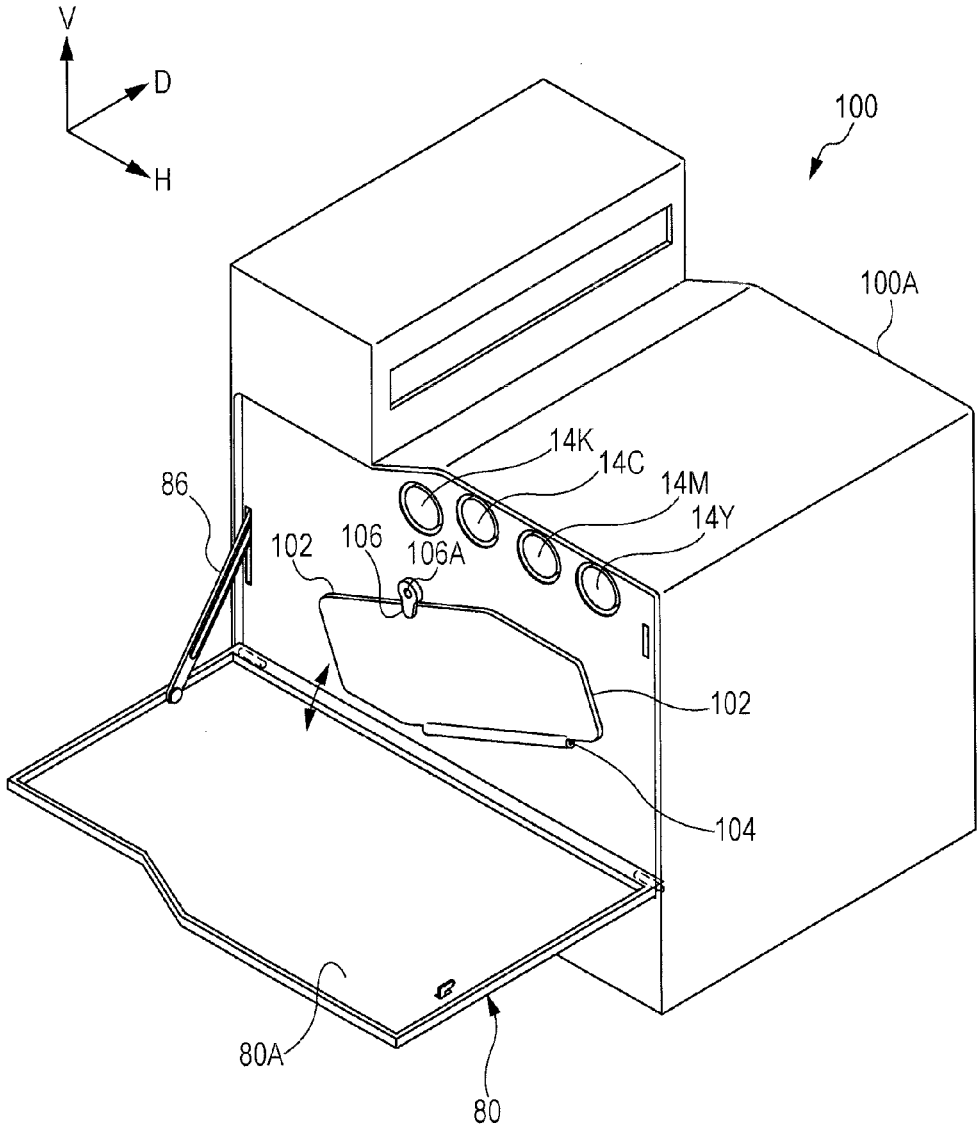
FIG. 8 is a perspective view of the image forming apparatus according to the second exemplary embodiment of the present invention.

Referring now to FIGS. 6 to 8, an image forming apparatus 100 according to a second exemplary embodiment of the present invention will be described. Components that are the same as those in the first exemplary embodiment are denoted by the same reference symbols and are not described. Components different from those in the first exemplary embodiment are mainly described below.

As illustrated in FIG. 8, in the image forming apparatus 100 according to the second exemplary embodiment, the image forming units 16 each including the charging device 36 are not exposed by opening the cover 80.

As illustrated in FIGS. 7 and 8, the image forming apparatus 100 includes a cover 102, serving as an example of an opening/closing member. The cover 102 is opened with respect to a portion of the external surface of the apparatus body 100A to expose the image forming units 16.

Cover

The cover 102 is white (has a brightness of 70% or higher, measured in accordance with JIS 8148). As illustrated in FIG. 6, this cover 102 is disposed so as to cover the image forming units 16 for different colors when viewed from the front of the apparatus body 100A in the state where the cover 102 is closed with respect to the apparatus body 100A.

As illustrated in FIGS. 7 and 8, a shaft member 104 that rotatably supports the cover 102 is disposed at a lower portion of the cover 102. A lever 106 that stops the cover 102 from being opened with respect to the apparatus body 100A is disposed at a portion above the cover 102.

The lever 106 is attached to the apparatus body 100A so as to be rotatable with respect to the apparatus body 100A around a shaft member 106A extending in the direction of the depth of the apparatus 10. This lever 106 is moved between a stop position (see FIG. 8) and an open position (see FIG. 7). In the stop position, the lever 106 comes into contact with the cover 102 at an end portion of the lever 106 and stops the cover 102 from being opened with respect to the apparatus body 100A. In the open position, the lever 106 allows the cover 102 to be separated from the lever 106 so that the cover 102 is opened with respect to the apparatus body 100A.

The image forming apparatus 100 also includes a retraction mechanism (not illustrated), which moves the first transfer rollers 52 upward by moving the lever 106 from the stop position to the open position so as to separate the intermediate transfer belt 42 from the image carriers 34. The image forming apparatus 100 also includes a separation mechanism (not illustrated), which moves the development rollers 39 by opening the cover 102 with respect to the apparatus body 100A so as to separate the development rollers 39 from the image carriers 34 (see FIG. 6).

In this structure, the lever 106 is moved to the open position, so that the cover 102 is rotated around the shaft member 104. Then, as illustrated in FIG. 7, the cover 102 is stopped rotating by a stopper, not illustrated, in the state where a back surface 102A of the cover 102 that has been facing the charging devices 36 faces upward, so that the cover 102 is opened with respect to the apparatus body 100A so as to expose the image forming units 16.

In the second exemplary embodiment, the toner cartridges 14 are attachable to and removable from the apparatus body 100A from the front side of the apparatus body 100A in the state where the cover 80 is opened with respect to the apparatus body 100A regardless of whether the cover 102 is opened or closed.

Sound Absorption Member

The sound absorption member 112 is formed of a plate of a porous material (for example, a polyurethane foam). As illustrated in FIG. 7, the sound absorption member 112 is attached to the back surface 102A of the cover 102 with a double-sided adhesive tape, an adhesive, or the like. As illustrated in FIG. 6, the sound absorption member 112 is disposed so as to cover the image forming units 16 when viewed from the front of the apparatus body 100A in the state where the cover 120 is closed with respect to the apparatus body 100A.

In other words, in the state where the cover 102 is closed with respect to the apparatus body 100A, the sound absorption member 112 covers at least a portion of the charging devices 36 when viewed from the front of the apparatus body 100A. The sound absorption member 112 is disposed in at least a portion of the range (the range H in FIG. 6) within which the image forming units 16 are positioned in the direction of the width of the apparatus body 100A. Since the sound absorption member 112 is positioned within the range H of FIG. 6 and the image forming units 16 are attached to or removed from the apparatus body 100A from the front side of the apparatus body 100A, the sound absorption member 112 is positioned in at least a portion of a region onto which an attachment/removal trajectory of the image forming units 16 is projected vertically downward (in the −V direction).

The sound absorption member 112 has such a thickness as to be deformable due to compression in the state where the cover 102 is closed with respect to the apparatus body 100A.

In this structure, the sound absorption member 112 absorbs a portion of the driving sound of components including the image carriers 34 and the development rollers 39 or a portion of the charging sound caused when the charging devices 36 electrically charge the surfaces of the image carriers 34.

Resin Sheet

The sound absorption member 112 has a smooth surface at a side facing the charging devices 36. One way to smooth the surface of the sound absorption member 112 at a side facing the charging devices is, as illustrated in FIG. 7, to attach a resin sheet 114 (for example, a PET sheet) to the entire surface of the sound absorption member 112, as an example of a flat plate member.

This resin sheet 114 has a color of white (has a brightness of 70% or higher, measured in accordance with JIS 8148), which is similar to the color tone of the cover 102. For example, the color difference ΔE between the color tone of the cover 102 and the color tone of the resin sheet 114 is 20 or lower.

Since the surface of the resin sheet 114 is smooth, the surface of the resin sheet 114 is easily cleanable when toner T adheres to the surface. One way to clean the surface is to wipe the toner T that has adhered to the surface of the resin sheet 114 from the surface of the resin sheet 114 with a dry cloth or the like. For example, as illustrated in FIG. 4B, the difference in height (dimension C in FIG. 4B) between a protrusion and a recess of the resin sheet 114 around toner T is smaller than the volume mean diameter of particles (volume mean diameter, the dimension D in FIG. 4B) of the toner T used in the image forming apparatus 100. Here, since the resin sheet 114 is a PET sheet, the resin sheet 114 is capable of being wiped with a damp cloth when the surface is excessively dirty.

Here, the attachment of the resin sheet 114 to the sound absorption member 112 reduces the sound absorption performance of the sound absorption member 112 compared to the case of a sound absorption member made only of a porous material. In this exemplary embodiment, however, the resin sheet 114 is attached to the surface of the sound absorption member 112 in order to improve the cleanability of the sound absorption member 112.

In this structure, when the image forming units 16 are attached to or removed from the apparatus body 100A from the front side of the apparatus body 100A in the state where the cover 102 is opened with respect to the apparatus body 100A, the toner T that has adhered to the image forming units 16 may fall off. Since the resin sheet 114 is attached to the sound absorption member 112, the toner T that has fallen off adheres to the surface of the resin sheet 114 and is thus prevented from clogging the sound absorption member 112. Since the resin sheet 114 has a smooth surface, the toner T that has adhered to the surface of the resin sheet 114 is wiped with a dry cloth or the like.

Others

As illustrated in FIG. 6, each image forming unit 16 includes a first unit 116 and a second unit 118. The first unit 116 is an example of a removable member that includes components such as a LED head 32, an image carrier 34, and a charging device 36. The second unit 118 is an example of a removable member that includes a development device 38. The first unit 116 and the second unit 118 are individually attachable to and removable from the apparatus body 100A.

Other Exemplary Embodiments

In the first exemplary embodiment or the second exemplary embodiment, the resin sheet 90 or 114 is attached to the corresponding sound absorption member 82 or 112. However, the back surface of the sound absorption member 82 or 112 may be subjected to a smoothing operation without attaching the resin sheet 90 or 114 to the sound absorption member 82 or 112. One example of the smoothing operation is to subject the surface of the sound absorption member 82 or 112 to a heating operation to apply pressure to the surface while melting the surface.

In the first exemplary embodiment or the second exemplary embodiment, the resin sheet 90 or 114 is attached to the corresponding sound absorption member 82 or 112. However, a structure in which the resin sheet 90 or 114 is not attached is also conceivable. In this case, toner T that has fallen off due to attachment or removal of the image forming units 16 or the toner cartridges 14 is received by the sound absorption member 90 or 112, whereby the cover 80 or 102 is prevented from becoming dirty. In this case, the sound absorption member 82 or 112 is preferably replaceable using, for example, a hook-and-loop fastener.

Although the resin sheet 90 or 114 is described as being white, the resin sheet 90 or 114 may have other colors. In such a case, as long as the resin sheet has a color other than the colors of the toner T, users are able to easily find the surface of the resin sheet 90 or 114 dirty.

Although the exemplary embodiments of the present invention have been described in detail as above, the present invention is not limited to these exemplary embodiments. It is obvious to practitioners skilled in the art that the invention are capable of being embodied in various other manners within the scope of the invention. For example, in some of the exemplary embodiments, the sound absorption member 82 or 112 is disposed so as to cover the image forming units 16 when viewed from the front of the apparatus body 10A or 100A in the state where the cover 80 or 102 is closed with respect to the apparatus body 10A or 100A. However, the sound absorption member 82 or 112 may be disposed so as to cover at least a portion of the charging devices 36 when viewed from the front of the apparatus body 10A or 100A. This structure enables minimization of the leakage of sound produced by the charging devices 36 to the front side of the apparatus body 10A or 100A.

What is claimed is:

1. An image forming apparatus, comprising:

an apparatus body including an image forming unit that forms an image;

an opening/closing member that is openable or closeable with respect to a portion of an external surface of the apparatus body; and an absorption member disposed on the opening/closing member at a side facing the image forming unit, the absorption member absorbing sound while facing a portion of the image forming unit in a state where the opening/closing member is closed with respect to the apparatus body, wherein the absorption member comprises a porous material and a resin sheet which is attached to a surface of the porous material that faces the image forming unit, the resin sheet having a smooth surface from which a toner, adhered onto the smooth surface, can be wiped.

2. The image forming apparatus according to claim 1, wherein the opening/closing member is rotated around a rotation shaft disposed at a lower portion of the opening/closing member so as to be opened or closed with respect to the apparatus body.

3. The image forming apparatus according to claim 1, wherein the image forming unit includes a charging device that electrically charges an image carrier that holds an image, and wherein the absorption member faces a portion of the charging device.

4. The image forming apparatus according to claim 2, wherein the image forming unit includes a charging device that electrically charges an image carrier that holds an image, and wherein the absorption member faces a portion of the charging device.

5. The image forming apparatus according to claim 2, wherein the image forming unit includes an image carrier that holds an image, a charging device that electrically charges the image carrier, and a development device that develops the image held on the image carrier charged by the charging device with developer, wherein the apparatus body includes a removable member that is attachable to or removable from the apparatus body and that includes at least one of the image carrier, the charging device, and the development device, wherein the removable member is attached to or removed from the apparatus body in a state where the opening/closing member is opened with respect to the apparatus body, and wherein the absorption member is positioned in at least a portion of a region onto which an attachment/removal trajectory of the removable member is projected vertically downward in the state where the opening/closing member is opened with respect to the apparatus body.

6. The image forming apparatus according to claim 4, wherein the image forming unit includes an image carrier that holds an image, a charging device that electrically charges the image carrier, and a development device that develops the image held on the image carrier charged by the charging device with developer, wherein the apparatus body includes a removable member that is attachable to or removable from the apparatus body and that includes at least one of the image carrier, the charging device, and the development device, wherein the removable member is attached to or removed from the apparatus body in a state where the opening/closing member is opened with respect to the apparatus body, and wherein the absorption member is positioned in at least a portion of a region onto which an attachment/removal trajectory of the removable member is projected vertically downward in the state where the opening/closing member is opened with respect to the apparatus body.

7. The image forming apparatus according to claim 2, further comprising a replenishment member that is replenished with developer that is to be fed to the image forming unit, wherein the replenishment member is attached to or removed from the apparatus body in a state where the opening/closing member is opened with respect to the apparatus body, and wherein the absorption member is positioned in at least a portion of a region onto which an attachment/removal trajectory of the removable member is projected vertically downward in the state where the opening/closing member is opened with respect to the apparatus body.

8. The image forming apparatus according to claim 4, further comprising a replenishment member that is replenished with developer that is to be fed to the image forming unit, wherein the replenishment member is attached to or removed from the apparatus body in a state where the opening/closing member is opened with respect to the apparatus body, and wherein the absorption member is positioned in at least a portion of a region onto which an attachment/removal trajectory of the removable member is projected vertically downward in the state where the opening/closing member is opened with respect to the apparatus body.

9. The image forming apparatus according to claim 5, wherein the opening/closing member and the absorption member have similar color tones at a side facing the image forming unit.

10. The image forming apparatus according to claim 6, wherein the opening/closing member and the absorption member have similar color tones at a side facing the image forming unit.

11. The image forming apparatus according to claim 7, wherein the opening/closing member and the absorption member have similar color tones at a side facing the image forming unit.

12. The image forming apparatus according to claim 8, wherein the opening/closing member and the absorption member have similar color tones at a side facing the image forming unit.

13. The image forming apparatus according to claim 5, wherein the resin sheet has a white surface at a side facing the image forming unit.

14. The image forming apparatus according to claim 6, wherein the resin sheet has a white surface at a side facing the image forming unit.

15. The image forming apparatus according to claim 7, wherein the resin sheet has a white surface at a side facing the image forming unit.

16. The image forming apparatus according to claim 8, wherein the resin sheet has a white surface at a side facing the image forming unit.

17. The image forming apparatus according to claim 1, wherein the resin sheet of the absorption member comprises a protrusion and a recess, and a difference in height between the protrusion and the recess of the resin sheet is smaller than a volume mean diameter of particles of the toner.

18. The image forming apparatus according to claim 1, wherein a color difference ΔE between a color tone of the opening/closing member and a color tone of the resin sheet is 20 or lower.

* * * * *